US007097220B2

(12) United States Patent
Haba

(10) Patent No.: US 7,097,220 B2
(45) Date of Patent: Aug. 29, 2006

(54) G-FORCE PUSH-PUSH LATCH

(75) Inventor: Charles A. Haba, Troy, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/711,525

(22) Filed: Sep. 23, 2004

(65) Prior Publication Data

US 2006/0061110 A1 Mar. 23, 2006

(51) Int. Cl.
*E05B 15/02* (2006.01)

(52) U.S. Cl. ..... 292/341; 292/DIG. 4

(58) Field of Classification Search ..... 292/341.17, 292/DIG. 4; 296/37.1, 37.8, 37.12
See application file for complete search history.

(56) References Cited

U.S. PATENT DOCUMENTS

| | | | | |
|---|---|---|---|---|
| 4,669,764 | A | 6/1987 | Bruck | |
| 4,988,134 | A | 1/1991 | Vidwans et al. | |
| 5,090,751 | A * | 2/1992 | Kobayashi | 292/71 |
| 5,267,761 | A | 12/1993 | Curtindale et al. | |
| 5,507,423 | A * | 4/1996 | Fischer et al. | 224/313 |
| 5,647,578 | A | 7/1997 | Bivens | |
| 5,657,969 | A | 8/1997 | Bivens | |
| 5,845,954 | A * | 12/1998 | DePue | 296/37.12 |
| 6,213,533 | B1 * | 4/2001 | Widulle et al. | 296/37.12 |
| 6,247,733 | B1 | 6/2001 | Weiland | |
| 6,669,250 | B1 | 12/2003 | St. Louis | |
| 6,808,214 | B1 * | 10/2004 | Sato et al. | 292/341.15 |
| 2002/0171251 | A1 | 11/2002 | Bieck et al. | |
| 2002/0096892 | A1 | 2/2003 | Sato et al. | |
| 2003/0062730 | A1 | 4/2003 | Shirase | |
| 2004/0075281 | A1 | 4/2004 | Ueki | |

FOREIGN PATENT DOCUMENTS

| | | |
|---|---|---|
| GB | 2 261 698 | 5/1993 |

* cited by examiner

*Primary Examiner*—Gary Estremsky
(74) *Attorney, Agent, or Firm*—Earl J. LaFontaine

(57) ABSTRACT

The push-push latch of the present invention is attached to a storage compartment and allows the door of the compartment to move between an open position and a closed position. The latch will remain closed and in a locked position when the door is subjected to a force greater than a predetermined force. The latch includes a track member and a guide member. The track member is molded of a polymer and generally defines a heart shaped track having an integrated retaining section and a channel connecting the heart shaped track and the retaining section. The guide member moves within the heart shaped track to facilitate opening and closing of the compartment door. In the event that the compartment door is subjected to a force greater than a predetermined value while in the closed position, the guide member will be forced through the channel and locked into the retaining section, thereby retaining the door in its closed position.

17 Claims, 1 Drawing Sheet

G-FORCE PUSH-PUSH LATCH

TECHNICAL FIELD

The present invention generally relates to a latch system used in association with automotive compartments. The present invention more particularly relates to a push-push latch for use in any compartment in an automobile within the head impact zone.

BACKGROUND OF THE INVENTION

Push-push latches are being used much more frequently in automotive compartments. There is a large probability that in the event of an accident, the push-push latch will be subjected to a force that opens the compartment and allows the objects within the compartment to exit as projectiles. Therefore, there is a need to retain the latch in a closed position in the event that the latch is subjected to an excessive force.

SUMMARY OF THE INVENTION

The present invention addresses this need by providing a push-push latch that can be used in association with an automotive compartment where the latch includes a track member that defines a generally heart shaped track having a V-shaped notch and a guide member that moves within the track to facilitate positioning the compartment door in the dosed position when the guide member rests in the V-shaped notch. Further, the track member is molded from a polymer and includes an integrated enclosed or bounded retaining section tat is positioned adjacent the V-shaped notch and a double wall channel that connects the heart shaped track to the retaining section.

BRIEF DESCRIPTION OF THE DRAWING

The present invention will be described by way of example with reference to the following drawings.

DETAILED DESCRIPTION OF THE PREFERRED EMBODIMENT

Figure 1:
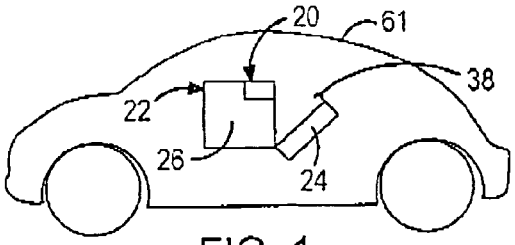
FIG. 1 illustrates a schematic view of an automotive overhead compartment with the door in the opened position.
Figure 2:
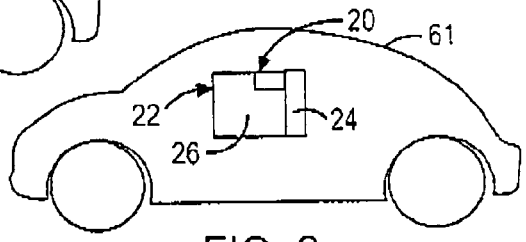
FIG. 2 illustrates a schematic view of art automotive overhead compartment with the door in the closed position.

The push-push latch of the present invention, shown generally at 20 in FIGS. 1–5, is used in association with a storage compartment 22 in an automobile 61 to facilitate moving the compartment door 24 between an opened position, as illustrated in FIG. 1, and a closed position, as illustrated in FIG. 2. It should be noted that the push-push latch of the present invention is not limited to automotive compartments, rather, it can be used in association with any compartment or environment that requires a latch.

When the door 24 is in the open position it is pushed by a user inwardly toward the compartment body 26 and engaged in the closed position. To open the door 24 from the closed position, the door 24 is again pushed inwardly toward the compartment body 26 and the latch 20 is disengaged, thus releasing the door 24 into the open position. In the event that the compartment door 24 is closed and subjected to a force that exceeds a predetermined value, the door 24 will become locked in the closed position.

Figure 3:
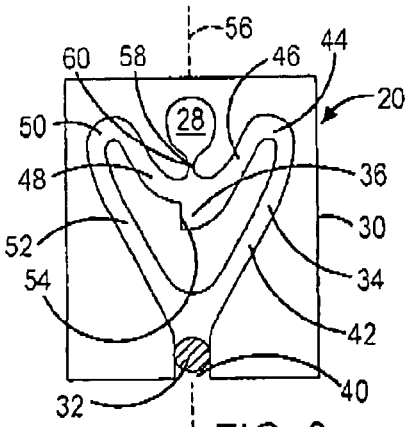
FIG. 3 illustrates a sectional view of the track member with the guide member in the opened position.
Figure 4:
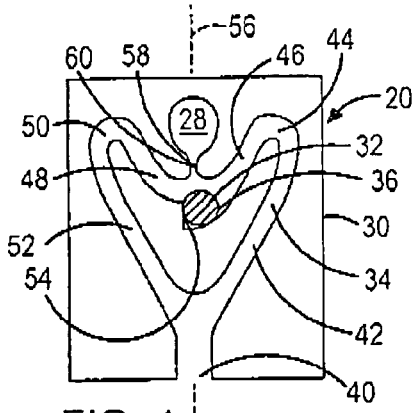
FIG. 4 illustrates a sectional view of the track member with the guide member in the closed position.
Figure 5:
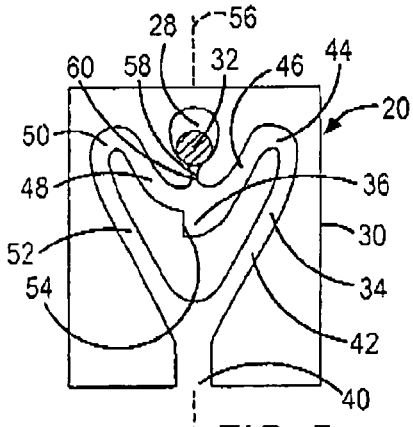
FIG. 5 illustrates a sectional view of the track member locked into the retaining section.

Referring to FIG. 3, the push-push latch 20 includes a track member 30 and a guide member 32. The track member 30 is molded from a polymer and defines a generally heart shaped track 34 having a V-shaped notch 36. The guide member 32 moves within the track 34 to facilitate positioning the compartment door 24 between the closed position and the opened position.

There is a connector 38, shown in FIG. 1, that is permanently attached to the compartment door 24 and that engages the push-push latch 20. In other words, neither the track member 30 nor the guide member 32 is permanently attached to the compartment door 24. Rather, the connector 38 engages either the track member 30 or the guide member 32 depending on the configuration of the system.

The heart-shaped track 34 includes pathway A also referred to as first pathway 40, pathway B also referred to as second pathway 42, first corner 44, pathway C also referred to as third pathway 46, the V-shaped notch 36, pathway D also referred to as fourth pathway 48, second corner 50, and pathway E also referred to as fifth pathway 52. The V-shaped notch 36 includes a wall 54 that assists in retaining guide member 32 in the closed position.

It is important to note that track member 30 has the ability to move axially along axis 56 and that guide member 32 has the ability to move radially with respect to axis 56.

Referring to FIG. 3, under normal circumstances when the door 24 of the compartment 22 is in the opened position the guide member 32 is resting in pathway A 40. When a force is exerted on the door 24 to push it into the closed position, the connector 38 on the compartment door 24 engages the push-push latch 20. This engagement forces guide member 32 to move from pathway A 40 into pathway B 42 and travel along the length of pathway B 42, and around the first corner 44 into pathway C 46. Guide member 32 moves along the length of pathway C 46 and comes to a rest at the V-shaped notch 36. Therefore, when in the closed position the guide member 32 is positioned in the V-shaped notch 36 of the track member 30 resting against wall 54.

When a force is exerted on the compartment door 24 in an effort to move the door 24 from the closed position to the opened position, under normal circumstances, guide member 32 is forced out from V-shaped notch 36 and into pathway D 48. After traveling the length of pathway D 48 guide member 32 moves around the second corner 50 and travels down the length of pathway E 52. Pathway E 52 merges into pathway A 40 and guide member 32 comes to a rest back in pathway A 40. The connector 38 disengages from the push-push latch 20 once guide member 32 is positioned within pathway A 40 causing the compartment door 24 to move into the opened position.

The majority of the time the compartment door 24 is going to be in the closed position. A user typically will open the door 24 only to put an object into the compartment 22 or to remove an object from the compartment 22 and immediately return the door 24 to the closed position. Therefore, the guide member 32 rests in the V-shaped notch 36 of the track member 30 the majority of the time.

In the event of an automobile collision, there is a chance that the compartment door 24 will be subjected to an excessive force. Therefore it is desired to keep the door 24 locked in its closed position under such circumstances, rater than being allowed to open thereby subjecting the vehicle occupant to an open door member or exposing them to the objects contained within the storage compartment 22. To address this situation, the present invention provides for a track member 30 that is molded from a polymer and includes an integrated retaining section 28 that is positioned adjacent the V-shaped notch 36 and an opening 58, also referred to as a channel 58, that connects the heart-shaped track 34 to the retaining section 28. In fact, the opening connects the V-shaped notch to the retaining section. The opening has a width dimension that is less than the width dimension of the guide member and less than the width dimension of all the pathways defining the heart-shaped path.

A force is considered to be excessive when it exceeds a predetermined value. One skilled in the art of push-push latches has the knowledge to define the parameters of an excessive force, but a typical range is 10–80 G's. If the force is less than the predetermined value, then the guide member 32 will move along the track member 30 as defined under normal conditions. However, if the force is greater than or equal to the predetermined value, then the guide member 32 will be forced into retaining section 28. Guide member 32 engages the opening or channel 58, forcing the walls 60 of the opening 58 to flex out in the radial direction with respect to axis 56 and the guide member 32 will move and lock into the retaining section 28. Once the guide member 32 is in the retaining section 28, the opening walls 60 will flex back into their normal positions. Once positioned in the retaining section 28, the compartment door 24 will lock in a closed position and will not open unless the guide member 32 is manually reset out of the retaining section 28.

Figure 6:
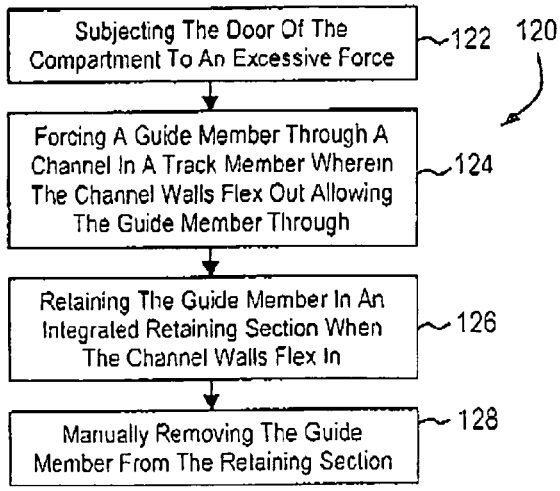
FIG. 6 is a flow chart illustrating the preferred method for this invention.

FIG. 6 schematically illustrates the preferred method of the invention 20. The flow chart 120 includes subjecting the door of the compartment to an excessive force at 122. At 124, the guide member is forced through the channel in the track member wherein the channel walls flex out allowing the guide member through. The guide member is retained in a retaining section that is an integral part of the track member when the channel walls flex back in, as illustrated at 126. When desired, the guide member must be manually removed from the retaining section at 128.

Described another way, the push-push latch of the present invention travels a routine path during normal operation allowing the door to move between an opened position and a closed position. However, the push-push latch of the present invention travels a non-routine path when the door of the compartment is subjected to a force greater than a predetermined force, thus locking the door in a closed position. The routine path of travel includes the generally heart shaped track including the V-shaved notch defined by the track member. The non-routine path of travel includes the opening connecting the V-shaped notch to the retaining section and including the retaining section, wherein the opening is narrower than the width of the guide member and the width of all other pathways of the heart shaped track.

While the present invention has been described in what is presently considered to be its most practical and preferred embodiment or implementation, it is to be understood that the invention is not to be limited to the disclosed embodiment. On the contrary, the present invention is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A push-push latch attached to a storage compartment having a door that moves between an opened position and a closed position, said push-push latch comprising:

a track member defining a generally heart shaped track having a generally V-shaped notch;

a guide member that moves within said track to facilitate positioning said compartment door in the closed position when said guide member rests in the V-shaped notch;

wherein said track member is molded from a polymer and includes an integrated enclosed retaining section adjacent said V-shaped notch and a double wall channel connecting said V-shaped notch and said enclosed retaining section, wherein said channel has a width dimension less than the width dimension of said guide member; and wherein when the compartment door is in the closed position and the guide member is positioned in the V-shaped notch and when subjected to a force greater than a predetermined value said guide member is forced directly from said V-shaped notch through said channel and locked into said retaining section locking said compartment door in the closed position.

2. The push-push latch of claim 1, wherein said walls of said channel flex out when said guide member is subjected to a force greater than a predetermined force value allowing said guide member through to said retaining section.

3. The push-push latch of claim 1 further comprising a connector attached to the compartment door.

4. The push-push latch of claim 1, wherein said heart shaped track further includes a pathway A, a pathway B, a first corner, a pathway C, a pathway D, a second corner, and a pathway E, wherein said pathway A is adjacent said pathway B and said pathway E, said pathway B is adjacent said first corner, said first corner is adjacent said pathway C, said pathway C is adjacent said V-shaped notch, said V-shaped notch is adjacent said pathway D, said pathway D is adjacent said second corner, and said second corner is adjacent pathway E.

5. The push-push latch of claim 4 wherein when the compartment door is in the opened position, said guide member is positioned in said pathway A.

6. The push-push latch of claim 4 wherein when the compartment door is moving from the opened position into the closed position, said guide member travels from said pathway A into and along the length of said pathway B, around said first corner, into and along the length of said pathway C, and coming to a rest in said V-shaped notch.

7. The push-push latch of claim 4 wherein when the compartment door is moving from the closed position into the opened position, said guide member travels from said V-shaped notch, into and along the length of said pathway D, around said second corner, into and along the length of said pathway E, and into said pathway A.

8. The push-push latch of claim 4 wherein when the compartment door is in the closed position and subjected to a force greater than a predetermined value, said guide member moves from said V-shaped notch into said channel forcing said walls to flex out and said guide member comes to a rest in said retaining section.

9. The push-push latch of claim 1, wherein said V-shaped notch includes a wall that assists in retaining said guide member in the closed position.

10. The push-push latch of claim 1, wherein said track member defines an axis and said guide member moves radially with respect to the axis to travel within said heart-shaped track.

11. The push-push latch of claim 1, wherein said storage compartment is in an automobile.

12. The push-push latch of claim 1, wherein said heart shaped track further includes a first pathway, a second pathway, a first corner, a third pathway, a fourth pathway, a second corner, and a fifth pathway, wherein said first pathway is adjacent said second pathway and said fifth pathway, said second pathway is adjacent said first corner, said first corner is adjacent said third pathway, said third pathway is adjacent said V-shaped notch, said V-shaped notch is adjacent said fourth pathway, said fourth pathway is adjacent said second corner, and said second corner is adjacent said fifth pathway.

13. A storage compartment comprising:

a compartment body;

a compartment door that is attached to said compartment body and moves between a closed position and an opened position;

a push-push latch that is attached to said compartment body and engages said compartment door, said push-push latch having a track member defining a generally heart shaped track having a generally V-shaped notch, a guide member that moves within said track to facilitate positioning said compartment door in the closed position when said guide member rests in the V-shaped notch, wherein said track member is molded from a polymer and includes an integrated bounded retaining section adjacent said V-shaped notch and a two wall channel connecting said V-shaped notch and said retaining section, said channel has a width dimension that is less than a width dimension of said heart shaped track; and wherein when the compartment door is in the closed position and the guide member is positioned in the V-shaped notch and when subjected to a force greater than a predetermined value said guide member is forced directly from said V-shaped notch through said channel causing said walls to flex out and locked into said retaining section when said walls flex back in.

14. The storage compartment of claim 13 wherein said track member defines an axis and said guide member moves radially with respect to the axis to travel within said heart-shaped track.

15. The storage compartment of claim 13 wherein said heart shaped track further includes a first pathway, a second pathway, a first corner, a third pathway, a fourth pathway, a second corner, and a fifth pathway, wherein said first pathway is adjacent said second pathway and said fifth pathway, said second pathway is adjacent said first corner, said first corner is adjacent said third pathway, said third pathway is adjacent said V-shaped notch, said V-shaped notch is adjacent said fourth pathway, said fourth pathway is adjacent said second corner, and said second corner is adjacent said fifth pathway.

16. A method of locking a compartment door in a closed position when subjected to an excessive force, wherein the compartment door moves between an opened and a closed position via a push-push latch made from a polymer and having a track member and a guide member, comprising the steps of:

A) subjecting the door of the compartment to an excessive force;

B) causing a guide member to move through a channel in a track member wherein the channel walls flex out allowing the guide member through; and C) retaining the guide member in an integrated bounded retaining section when the channel walls flex in.

17. The method of claim 16 further comprising manually removing the guide member from the retaining section.

* * * * *